US005163830A

United States Patent [19]

Pfefferkorn

[11] Patent Number: 5,163,830

[45] Date of Patent: Nov. 17, 1992

[54] FUEL-AIR MIXER TUBE

[75] Inventor: Earle L. Pfefferkorn, Racine, Wis.

[73] Assignee: Greene Manufacturing Company, Racine, Wis.

[21] Appl. No.: 752,025

[22] Filed: Aug. 29, 1991

[51] Int. Cl.[5] ..... F23D 14/62; B01F 15/02

[52] U.S. Cl. ..... 431/355; 431/354; 366/163

[58] Field of Search ..... 431/354, 355; 48/180.01; 261/116; 29/890.02; 239/428.5, 398; 126/39 R, 39 E; 366/338

[56] References Cited

U.S. PATENT DOCUMENTS

| | | | |
|---|---|---|---|
| Re. 32,133 | 5/1986 | Koziol | 126/39 E |
| 347,561 | 8/1886 | Bisbee . | |
| 785,354 | 3/1905 | Fowler . | |
| 843,379 | 2/1907 | Williams . | |
| 1,018,445 | 2/1912 | Ronstrom . | |
| 1,127,972 | 2/1915 | Elfreich . | |
| 1,560,248 | 11/1925 | Kerr | 431/355 X |
| 1,669,631 | 5/1928 | Smith | 431/355 X |
| 1,821,797 | 9/1931 | Gonzalez | 126/39 E |
| 1,874,970 | 8/1932 | Hall . | |
| 1,961,751 | 6/1934 | Feyling | 158/106 |
| 2,015,266 | 9/1935 | Gerer | 431/355 X |
| 2,349,323 | 5/1944 | Whittington | 431/355 |
| 2,547,850 | 4/1951 | Brown | 431/355 |
| 3,785,361 | 1/1974 | Mejyr et al. | 126/41 R |
| 3,816,062 | 6/1974 | Bouvier | 431/355 |
| 4,118,175 | 10/1978 | Riehl | 431/354 |
| 4,353,347 | 10/1982 | Seed | 126/41 R |
| 4,488,534 | 12/1984 | Koziol | 126/25 R |
| 4,565,521 | 1/1986 | Hancock | 431/75 |
| 4,624,240 | 11/1986 | Hitch | 126/41 R |
| 4,679,544 | 7/1987 | Koziol | 126/41 R |
| 4,738,614 | 3/1988 | Snyder et al. | 431/8 |
| 4,762,530 | 8/1988 | Koziol | 48/180.1 |
| 4,773,384 | 9/1988 | Koziol | 126/41 R |
| 4,817,583 | 4/1989 | Hanagan et al. | 126/41 R |
| 4,827,899 | 5/1989 | Walters et al. | 126/41 R |
| 4,827,903 | 5/1989 | Kim | 126/299 R |
| 4,829,978 | 5/1989 | Schlosser | 126/41 R |
| 4,872,833 | 10/1989 | Kramer | 431/354 |
| 4,904,182 | 2/1990 | Leshner | 431/354 |
| 5,062,788 | 11/1991 | Best | 431/354 X |

FOREIGN PATENT DOCUMENTS

| | | | |
|---|---|---|---|
| 355775 | 2/1930 | United Kingdom | 431/355 |

*Primary Examiner*—Carl D. Price
*Attorney, Agent, or Firm*—Jansson & Shupe, Ltd.

[57] ABSTRACT

The improved fuel-air mixer tube is devoid of secondary air ports and includes a passage for flowing gaseous fuel to a burner and a restrictor accelerating such gaseous fuel through a region of maximum gas velocity. An air entry port is in flow communication with such region for supplying primary air required to form a combustible mixture. The tube is thereby naturally aspirated and gaseous fuel and air are turbulently mixed to form a substantially homogeneous mixture.

5 Claims, 5 Drawing Sheets

FUEL-AIR MIXER TUBE

FIELD OF THE INVENTION

This invention relates generally to gas-fueled burners and, more particularly, to tubes for mixing gaseous fuel and air for combustion by a burner.

BACKGROUND OF THE INVENTION

Gas cooking grills and the like are usually constructed such that the source of gas (frequently a pressurized tank) and the burner are physically separated from one another. Such separation requires that a conduit be provided for connecting such source to the burner and flowing gaseous fuel thereto. Such conduits usually include a gas tube assembly which is flexible (to adapt to a variety of tank-burner positions) and which permits the introduction of air into the gas stream. Of course, the reason for introducing air is to provide the proper fuel-air mixture to result in clean, complete combustion. An example of such a tube assembly is shown in U.S. Pat. No. 4,827,899 (Walters et al.) and includes an air-entry aperture, the area of which is adjustable. Such adjustability is desirable when a burner is to be used with more than one type of fuel. Other examples of tube assemblies are shown in U.S. Pat. Nos. 4,679,544 (Koziol) and RE32,133 (Koziol—reissue of 4,373,505).

Another type of fuel-air mixer tube is shown in U.S. Pat. No. 4,827,903 (Kim). Such tube is now less common, notwithstanding its depiction in a relatively recent patent. Such tube includes a gently tapered hourglass-shaped venturi section having a length substantially greater than the diameter of the tube. An air entry port is spaced from the venturi section on the "downstream" end of the tube, i.e., that end of the tube nearer the burner. While venturi sections are know to accelerate the velocity of gaseous fuel flowing therethrough (and therefore lower its pressure), the illustrated port is at an area of maximum tube diameter where the velocity of the fuel has decreased to (or substantially to) its "pre-venturi" value. Such configuration has been found to be less than highly effective in introducing air into the gas stream—and of dubious value in causing good fuel-air mixing.

A gas burner is shown in U.S. Pat. No. 1,961,751 (Feyling). The Feyling device combines a burner with a mixer tube which is several times the diameter of the burner located at the upper end of the illustrated device. The Feyling burner to be used in an upright position, also has two or three restrictor portions, depending upon the variation under consideration. In either variation, the first restriction "necks down" the inlet passage while the second restriction includes a nozzle with a very small orifice. In one of the variations, the mixer tube is combined with a mixing chamber having an area of reduced diameter forming a third restriction. Such chamber gradually enlarges in diameter toward the burner "downstream" end. The Feyling patent explains that a straight mixer tube, i.e., one with a mixing chamber of uniform diameter, may also be used.

While one can only estimate the cross-sectional area of the orifice, its diameter appears to be less than 10% of that of the inlet upstream of it. Therefore, its area would be less than 1% of that of the inlet. Four air entry holes are provided adjacent to and downstream of the orifice-like nozzle. Such holes are to permit the entry of primary air to be mixed with gas and form a combustible mixture. In all configurations, the Feyling burner has projections at the top of the mixer tube to permit "secondary air" to flow to the top side of the flame to give "complete combustion." The Feyling device is not suitable for use with a remote burner—it is the burner.

U.S. Pat. Nos. 843,379 (Williams); 4,565,521 (Hancock) and the Kim patents all show devices in which the air entry port (or ports) are spaced from a restrictor portion and located downstream thereof. To put it another way, such ports communicate with the interior of the tube at a location where the interior cross-sectional area of such tube is unrestricted. Such port location is not at the region of highest gas velocity.

U.S. Pat. No. 4,738,614 (Snyder et al.) shows an atomizer for a post-mixer burner. The Snyder et al. atomizer includes a restrictor portion having a length about equal to the outer diameter of the device. Angularly-arranged atomizing passages are formed in the side wall to intersect the restrictor portion where such portion starts to enlarge toward its normal cross-sectional area. Liquid fuel flows in the main flow path while an atomizing fluid, e.g., steam or nitrogen, is introduced under high pressure through the atomizing passages in the side wall.

OBJECTS OF THE INVENTION

It is an object of the invention to overcome some of the problems and shortcomings of the invention including those mentioned above.

Another object of the invention is to provide an improved fuel-air mixer tube wherein the area of the air inlet needs no adjustment.

Still another object of the invention is to provide an improved fuel-air mixer tube which permits complete combustion of the gas while yet avoiding the need for an entry passage for secondary air.

Yet another object of the invention is to provide an improved fuel-air mixer tube which may be readily constructed from thin wall tubing.

Another object of the invention is to provide an improved fuel-air mixer tube for use with a single type of gaseous fuel. Other objects of the invention will become apparent from the following description.

SUMMARY OF THE INVENTION

The inventive fuel-air mixer tube is intended for use with outdoor cooking grills and the like having burners fueled by natural gas or liquid propane (LP) bottled gas. More recently, the great majority of such grills have been fueled by LP gas and the mixer tube disclosed herein is configured for use with such fuel. After understanding the following description, one of ordinary skill will appreciate how to modify the new mixer tube for use with natural gas. The mixer tube defines part (or possibly all) of the flow path between the compressed fuel storage tank and the grill burner.

In general, the improved fuel-air mixer tube includes a passage for flowing gaseous fuel to a burner and a restrictor accelerating such gaseous fuel through a region of maximum gas velocity. Such region is at or very near such restrictor and an air entry port is in air flow communication with such region. The tube is thereby naturally aspirated and gaseous fuel and air are turbulently mixed to form a generally homogeneous mixture.

While a tube of generally uniform cross-sectional area is preferred for making the new mixer tube, the cross-sectional shape of the tube can be any one of several regular geometrical shapes or of an irregular shape. However, a highly preferred embodiment includes a metallic thin-wall tube having a circular cross-sectional shape.

The restrictor and the air entry port can be formed in a variety of configurations. For example, the restrictor may include an inwardly-extending deformation formed by "crimping" the tube wall inward. And such deformation may asymmetrically extend only part way around the wall or it may entirely circumscribe the wall and thereby be symmetrical. In those mixer tubes where the restrictor includes such inwardly-extending deformation, no opening in the tube wall need be made to provide such deformation.

The tube has a central longitudinal axis and a maximum interior dimension measured normal to such axis. Of course, when a tube of circular cross-section is used, such maximum interior dimension is equal to the inside diameter of the tube. The deformation has a length measured parallel to such longitudinal axis and, preferably, such length is less than such interior dimension. In a highly preferred embodiment, such length is not greater than about one-half such interior dimension.

The mixer tube also includes an air entry port—or two or more such entry ports. In one preferred embodiment, such port is generally circular in shape although ports of oval or other shapes may be used. Such port has a perimeter portion in contact with or closely adjacent to such restrictor at the "downstream" side thereof, i.e., that side nearer the burner or other fuel-consuming device. When so positioned, such port substantially shares a common boundary with the restrictor. Such port will also thereby be in substantial flow communication with the region of maximum gas velocity.

In another preferred embodiment, the restrictor includes a tab extending into such tube and attached thereto along a tab edge. For certain tab configurations, the tab may be formed by inwardly piercing the tube wall with a chisel-like tool sharpened and shaped to cleanly penetrate such wall with little, if any, unwanted bending of the wall in the vicinity of the tab. The "line of attachment" of the tube and the tab will be toward the upstream end of the tube and the tab extends into the tube interior and toward the downstream end of such tube.

In the embodiment described immediately above, the restrictor and the air entry port are formed simultaneously when the tube wall is pierced. That is, bending the tab inward during the piercing operation provides the restrictor, the inwardly-extending tab, as well as the air entry port, i.e., the opening left in the tube wall when the tab is so bent. And like the embodiment described above, such port has a perimeter portion in contact with or closely adjacent such restrictor at the "downstream" side thereof, i.e., that side nearer the burner or other fuel-consuming device. When so positioned, such port substantially shares a common boundary with the restrictor. Such port will also thereby be in substantial flow communication with the region of maximum gas velocity.

In a highly preferred embodiment, a plane normal to the central longitudinal axis of the tube includes all ports. To stated it another way, the ports are generally aligned with one another about the perimeter of the tube rather than being "staggered" up and down the length of the tube. When so configured, the restrictor which includes the inwardly-bent tabs has a length measured parallel to the tube longitudinal axis which is less than the maximum interior dimension of the tube. In a highly preferred embodiment, such length is not greater than about one-half such interior dimension.

In all configurations, the air entry port has a flow axis. Preferably, such axis is angularly disposed with respect to the longitudinal axis of the tube. When viewed along the direction of air flow, such flow axis extends toward the tube interior and toward the downstream end of the tube. Such configuration acts as an "air guide" and helps air flow to the interior of the tube with minimum pressure drop across the port. And in all configurations, the entire supply of primary air, i.e., air mixed with gas to form a combustible mixture, enters at the entry ports. That is, the tube is devoid of ports for secondary air which maintains combustion. Such secondary air ports are adjacent to or part of the remote burner with which the inventive tube is used.

As is apparent to one of ordinary skill, the cross-sectional area of the tube selected for making the invention must be sufficient to accommodate the anticipated flow rate of gas. Such flow rate is primarily a function of burner size and design BTU output of the grill or other heating unit under consideration. For purposes of the following explanation, it will be assumed that a tube of circular cross-section is selected to make the invention. After appreciating the teaching of the specification and drawing, one of ordinary skill will understand how to apply the following guidelines in making the new mixture tube.

Assuming the inlet end of the tube has a diameter D, the length of that portion of the tube "upstream" of the beginning of the restriction should be from one to six times the diameter. For example, if the tube diameter is one inch, the aforementioned portion should be from one to six inches long prior to forming the restriction.

The deformation or tab forming the restriction should slope rather gradually inward and an angle of between 15 and 45 degrees is preferred. The minimum dimension at the restricted portion (measured normal to the longitudinal center axis of the tube) is preferably from one-half to one-fourth the diameter D. As a rough approximation, the cross-sectional area of the restricted portion will therefore be in the range of about 8% to 25% of that of the inlet end of the tube.

In some embodiments of the invention, the tab forming the restrictor includes a front or flow guide lip extending downstream parallel to the longitudinal axis. The length of such lip is preferably determined by experimentation but, in general, a length equal to 15-25% of the diameter will function well.

Other details of the invention are set forth below.

DETAILED DESCRIPTION OF PREFERRED EMBODIMENTS

Figure 14:
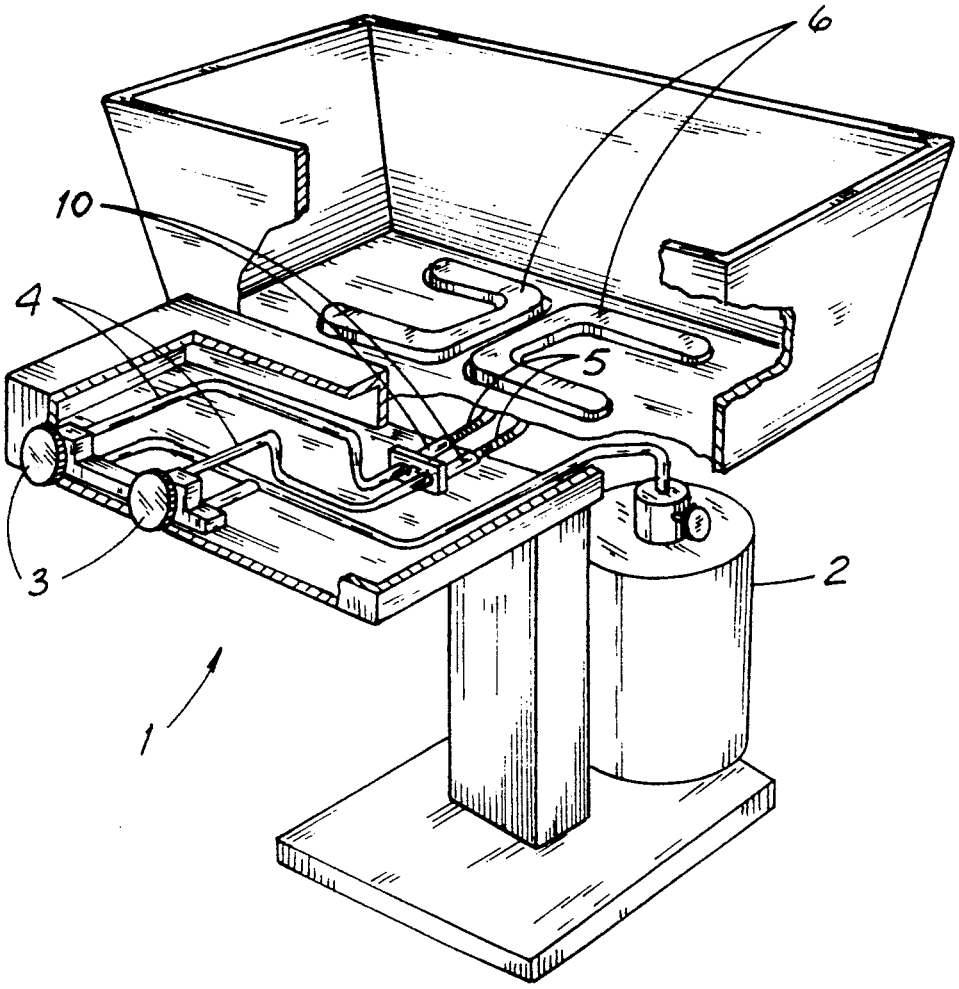
FIG. 14 is a representative isometric view showing a cooking grill of the type in which the new fuel-air mixer tube is used.

Referring first to FIG. 14, a typical cooking grill 1 includes a tank 2 of combustible gas such as liquefied propane or natural gas. The tank 2 is connected to shut-off valves 3, each of which is connected by a tube 4 to a fuel-air mixer tube 10 of the invention. The tube 10 can be used in any position. Flexible tubing 5 may be installed upstream or downstream of the tube 10 for ease of alignment and in any event, connection is finally to the remote gas burners. Typically, secondary air needed to maintain combustion enters through holes in the bottom of the grill "kettle."

Referring next to FIGS. 1-12, the improved fuel-air mixer tube 10 includes a longitudinal axis 11 and an upstream end 13 for connection to a source of combustible gaseous fuel. The downstream end 15 connects to the burner 6.

The tube 10 also includes a passage 15 for flowing gaseous fuel to a burner and a restrictor 17 accelerating such gaseous fuel through a region 19 of maximum gas velocity. Such region 19 is at or very near such restrictor and one or more air entry ports 21 are in air flow communication with such region 19. The tube 10 is thereby naturally aspirated and gaseous fuel and air are turbulently mixed to form a generally homogeneous mixture.

While a tube of generally uniform cross-sectional area is preferred for making the new mixer tube 10, the cross-sectional shape of the tube can be any one of several regular geometrical shapes or of an irregular shape. However, a highly preferred embodiment includes a metallic thin-wall tube 23 having a circular cross-sectional shape and details of the invention are explained by depicting tubes of such shape. As those of ordinary skill will appreciate after understanding the specification, other shapes can be used.

Figure 3:
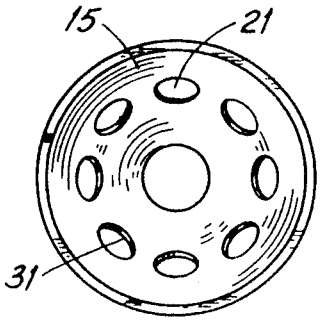
FIG. 3 is an elevation view of the downstream or outlet end of the tube of FIG. 1 taken along the viewing plane 3—3 thereof.
Figure 2A:
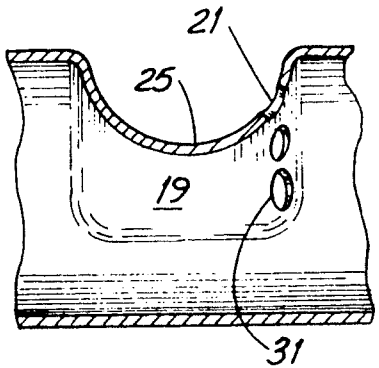
FIG. 2A is a cross-section view, with parts broken away, of a portion of the tube of FIG. 1 showing an asymmetrical variation thereof.
Figure 1:
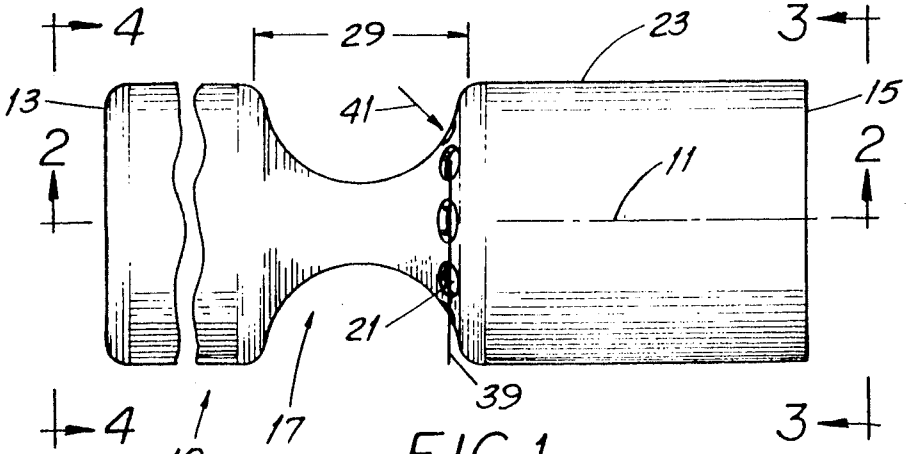
FIG. 1 is a side elevation view of one embodiment of the inventive tube in which a restrictor is formed by deformation.
Figure 2:
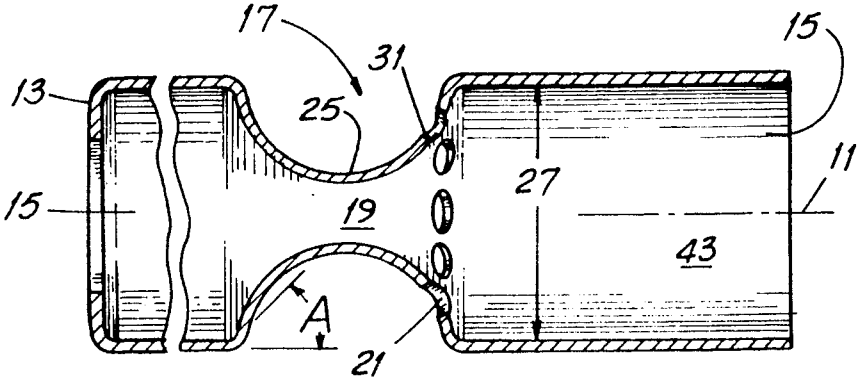
FIG. 2 is a cross-sectional view of the tube of FIG. 1 taken along the viewing plane 2—2 thereof.
Figure 4:
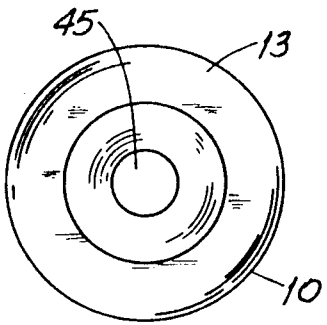
FIG. 4 is an elevation view of the upstream or inlet end of the tube of FIG. 1 taken along the viewing plane 4—4 thereof.
Figure 7:
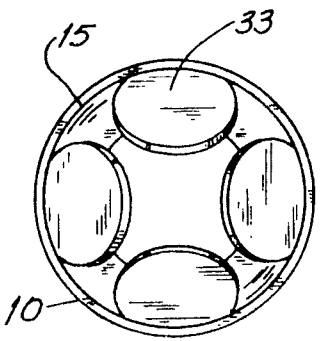
FIG. 7 is an elevation view of the downstream or outlet end of the tube of FIG. 5 taken along the viewing plane 7—7 thereof.
Figure 5:
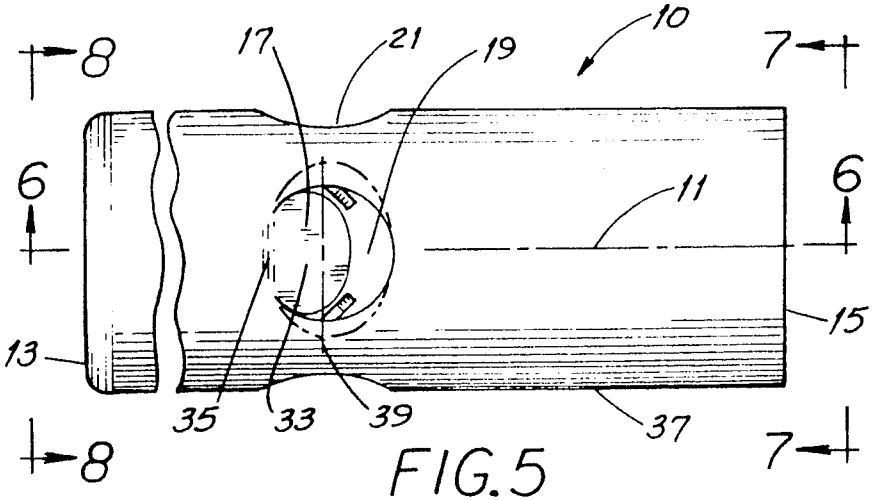
FIG. 5 is a side elevation view of a second embodiment of the inventive tube in which a restrictor is formed by inwardly-bent circular tabs. A variation is shown in dotted outline.

The restrictor 17 and the air entry port 21 can be formed in a variety of configurations. For example (and referring to FIGS. 1-4), the restrictor 17 may include an inwardly-extending deformation 25 formed by "crimping" the tube wall inward. And such deformation 25 (and the related air entry ports) may extend asymmetrically only part way around the tube 10 as shown in FIG. 2A or it may entirely circumscribe the tube 10 as shown in FIG. 2 and thereby be symmetrical.

The tube 10 has a central longitudinal axis 11 and a maximum interior dimension 27 measured normal to such axis. Of course, when a tube of circular cross-section is used, such maximum interior dimension 27 is equal to the inside diameter of the tube 10. The deformation 25 has a length 29 measured parallel to such longitudinal axis and, preferably, such length 29 is less than such interior dimension 27. In a highly preferred embodiment, such length 29 is not greater than about 50-60% of the interior dimension 27.

The mixer tube 10 also includes an air entry port 21 —or two or more such entry ports 21. In one preferred embodiment shown in FIGS. 1-4, such port 21 (or each port 21) is generally circular in shape although ports 21 of oval or other shapes may be used. Such port 21 has a perimeter portion 31 in contact with or closely adjacent such restrictor 17 at the "downstream" side thereof, i.e., that side nearer the burner or other fuel-consuming device. When so positioned, such port 21 substantially shares a common boundary with the restrictor 17. Such port 21 will also thereby be in substantial flow communication with the region of maximum gas velocity 19.

In the preferred embodiments shown in FIGS. 5-8 and 9-12, the restrictor 17 includes a tab 33 extending into such tube 10 and attached thereto along a tab edge 35. For certain tab configurations, the tab 35 may be formed by inwardly piercing the tube wall 37 with a chisel-like tool sharpened and shaped to cleanly penetrate such wall 37 with little, if any, unwanted bending of the wall 37 in the vicinity of the tab 33. The "line of attachment" of the tube 10 and the tab 33 is toward the upstream end 13 of the tube 10 and the tab 33 extends into the tube interior and toward the downstream end 15 of such tube 10. The embodiment of FIGS. 5-8 lends itself particularly well to forming by piercing.

And the tabs 33 need not be circular as shown in FIGS. 5-8 in solid outline. They may be oval as shown in dash-dot outline in FIG. 5 or of another shape. Similarly, the tabs 33 shown in FIGS. 9-12 may be square as shown in solid outline, rectangular as shown in dash-dot outline in FIG. 9 or of another shape. Further, tabs 33 need not extend around the perimeter of the tube 10. Only a few tabs 33 placed along such perimeter result in a functional tube of asymmetrical configuration.

When the tube wall 37 is pierced, the restrictor 17 and the air entry port 21 are formed simultaneously. That is, bending the tab 33 inward during the piercing operation provides the restrictor 17, the inwardly-extending tab 33, as well as the air entry port 21, i.e., the opening left in the tube wall 37 when the tab 33 is so bent. And like the embodiment first described above, such port 21 has a perimeter portion 31 in contact with or closely adjacent such restrictor 17 at the "downstream" side thereof, i.e., that side nearer the burner or other fuel-consuming device. That is, in the embodiments of FIGS. 5-12, the outer surface of the tab 33 forms a part of the port perimeter. When so positioned, such port 21 substantially shares a common boundary with the restrictor 17. Such port 21 will also thereby be in substantial flow communication with the region of maximum gas velocity 19.

In a highly preferred embodiment, a plane 39 normal to the central longitudinal axis 11 of the tube 10 includes all ports 21. To state it another way, the ports 21 are generally aligned with one another about the perimeter of the tube 10 rather than being "staggered" up and down the length of the tube 10. When so configured, the restrictor 17 which includes the deformation 25 or inwardly-bent tabs 33 has a length 29 measured parallel to the tube longitudinal axis which is less than the maximum interior dimension 27 of the tube. In a highly preferred embodiment, such length is not greater than about 50–60% of such interior dimension.

In all configurations, the air entry port 21 has a flow axis 41. Preferably, such axis 41 is angularly disposed with respect to the longitudinal axis 11 of the tube 10. When viewed along the direction of air flow, such flow axis 41 extends toward the tube interior 43 and toward the downstream end 15 of the tube 10. Such configuration acts as an "air guide" and helps air flow to the interior 43 of the tube 10 with minimum pressure drop across the port 21. And in all configurations, the entire supply of air needed to form a combustible mixture enters at the entry port(s) 21.

As is now apparent to one of ordinary skill, the cross-sectional area of the tube selected for making the invention 10 must be sufficient to accommodate the anticipated flow rate of gas. Such flow rate is primarily a function of burner size and design BTU output of the grill or other heating unit under consideration. For purposes of the following explanation, it will be assumed that a tube of circular cross-section is selected to make the invention 10. After appreciating the teaching of the specification and drawing, one of ordinary skill will understand how to apply the following guidelines in making the new mixture tube.

Figure 13:
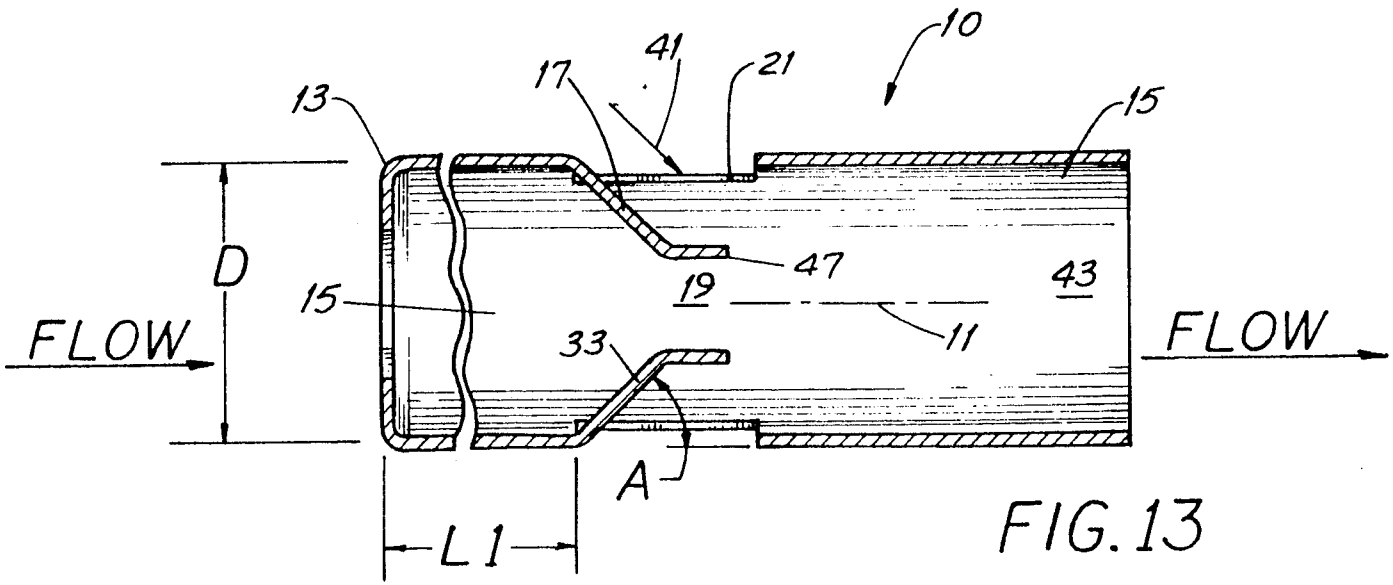
FIG. 13 is a cross-sectional view of a variation of the embodiment of FIG. 10 showing a flow guide lip.

Referring to FIG. 13 and assuming the inlet end 13 of the tube 10 has a diameter D, the length L1 of that portion of the tube 10 "upstream" of the beginning of the restrictor 17 should be from one to six times the diameter. For example, if the tube diameter is one inch, the aforementioned portion should be from one to six inches long prior to forming the restrictor 17.

Figure 6:
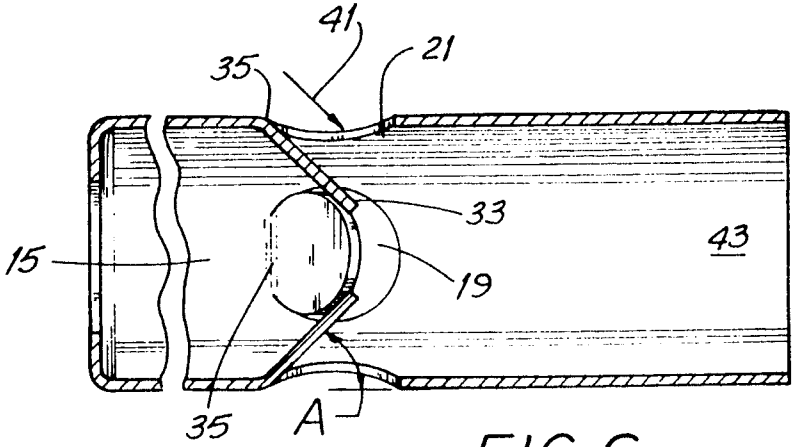
FIG. 6 is a cross-sectional view of the tube of FIG. 5 taken along the viewing plane 6—6 thereof.
Figure 8:
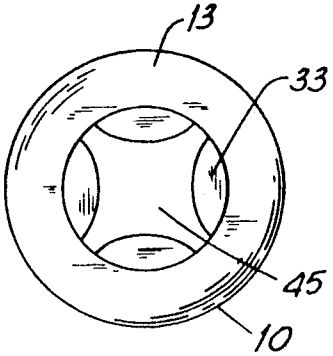
FIG. 8 is an elevation view of the upstream or inlet end of the tube of FIG. 5 taken along the viewing plane 8—8 thereof.
Figure 11:
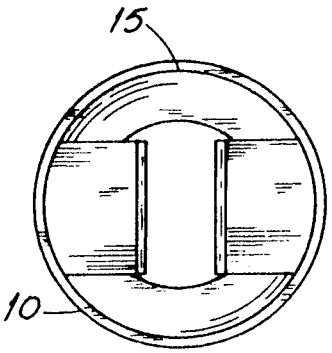
FIG. 11 is an elevation view of the downstream or outlet end of the tube of FIG. 9 taken along the viewing plane 11—11 thereof.
Figure 9:
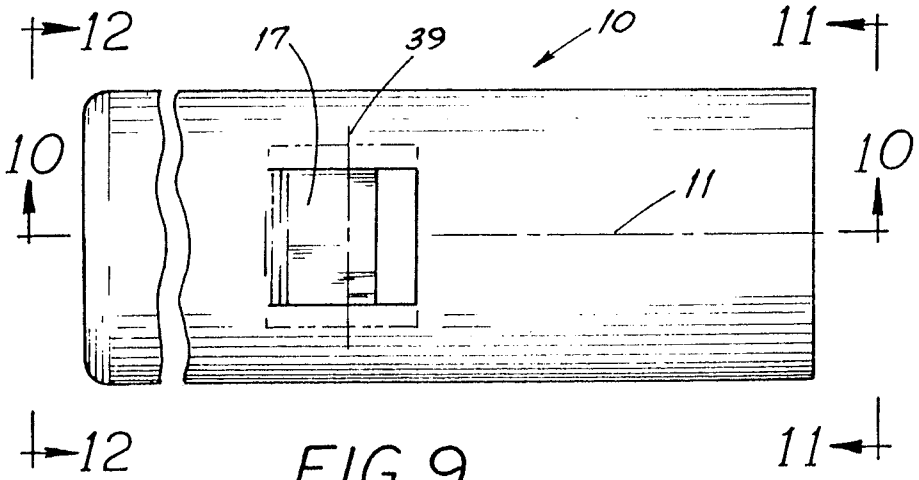
FIG. 9 is a side elevation view of a third embodiment of the inventive tube in which a restrictor is formed by inwardly-bent rectangular tabs. A variation is shown in dotted outline.
Figure 10:
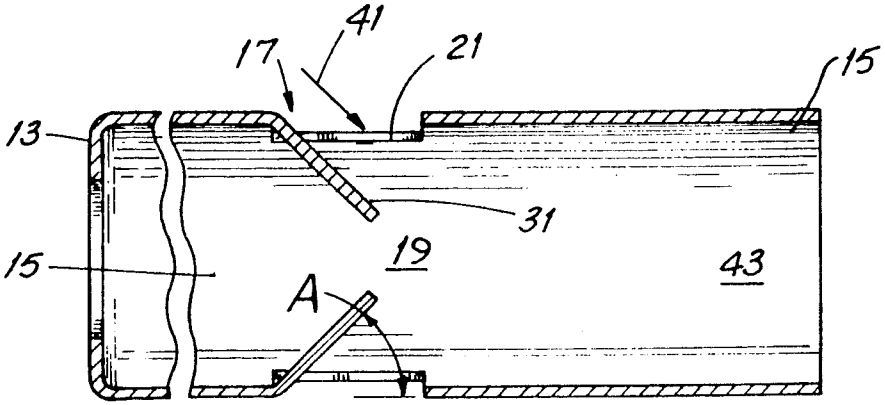
FIG. 10 is a cross-sectional view of the tube of FIG. 9 taken along the viewing plane 10—10 thereof.
Figure 12:
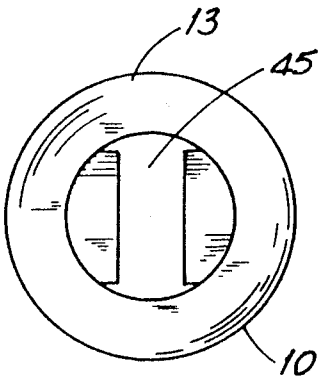
FIG. 12 is an elevation view of the upstream or inlet end of the tube of FIG. 9 taken along the viewing plane 12—12 thereof.

Referring additionally to FIGS. 2, 6 and 10, the deformation 25 or tab 33 forming the restrictor 17 should slope rather gradually inward and an angle A of between 15 and 45 degrees is preferred. For this venturi-like tube 10, the minimum dimension at the restrictor 17 (measured normal to the longitudinal center axis of the tube 10) is preferably from about one-half to one-fourth the diameter D. As a rough approximation, the cross-sectional area of the restricted portion 45 will therefore be in the range of about 8% to 25% of that of the inlet end 13 of the tube 10.

As particularly shown in FIG. 13 and in some embodiments of the invention, the tab 33 forming the restrictor 17 includes a front or flow guide lip 47 extending downstream parallel to the longitudinal axis 11. The length of such lip 47 is preferably determined by experimentation but, in general, a length equal to 15–25% of the diameter D will function well.

Referring again to FIGS. 2, 6, 10 and 13 and in operation, substantially pure gaseous fuel enters the inlet end 13 and flows at a velocity along the passage 15 and through the restrictor 17. Because the restrictor 17 presents an area less than that of the passage 15, the fuel is accelerated to a higher velocity. However, as the fuel flows through the region of maximum velocity 19, that where the area of the restricted portion 45 is smallest, a lowered pressure zone is created as is turbulence. The air inlet ports 21 are in flow communication with such region 19 and air is naturally aspirated into the passage 15. Turbulence mixes the air and fuel substantially homogeneously.

While the invention has been described in connection with a few exemplary embodiments, it is not intended to be so limited and other embodiments are possible without departing from the invention.

I claim:

1. An improved fuel-air mixer tube devoid of secondary air ports and providing a combustible fuel-air mixture to a remote burner, including:

tube passage for flowing gaseous fuel to a remote burner;

a tube restrictor accelerating such fuel through a region of maximum gas velocity and including a plurality of angularly-arranged tabs extending into such tube to form a plurality of air entry ports;

at least one air entry port in flow communication with such region for supplying primary air required for such mixture combustion;

whereby such tube is naturally aspirated and gaseous fuel and air are turbulently mixed to form a generally homogeneous mixture.

2. The mixer tube of claim 1 wherein each such tab includes a flow guide lip at its inward end.

3. The mixer tube of claim 1 wherein such tabs are formed by piercing the tube.

4. An improved fuel-air mixer tube devoid of secondary air ports and providing a combustible fuel-air mixture to a remote burner, including:

a passage for flowing gaseous fuel to a remote burner;

a restrictor for accelerating the fuel through a region of maximum gas velocity and including a downstream side and a plurality of tabs extending into the passage;

at least one primary air entry port adjacent to a tab and to the restrictor downstream side and supplying primary air required for such mixture combustion; whereby such tube is naturally aspirated and gaseous fuel and air are turbulently mixed to form a generally homogeneous mixture.

5. The mixer tube of claim 4 formed of thin-wall metal tubing having holes pierced therein and the tabs are formed during hole piercing.

* * * * *